US005887793A

United States Patent [19]

Kieffer

[11] Patent Number: 5,887,793

[45] Date of Patent: Mar. 30, 1999

[54] DUAL MODE REVERSIBLE SPRAY TIP

[75] Inventor: Joseph W. Kieffer, Rogers, Minn.

[73] Assignee: Wagner Spray Tech Corporation, Minneapolis, Minn.

[21] Appl. No.: 871,365

[22] Filed: Jun. 9, 1997

[51] Int. Cl.[6] ..... B05B 15/02

[52] U.S. Cl. ..... 239/119; 239/288.3

[58] Field of Search ..... 239/119, 288, 239/288.3, 288.5

[56] References Cited

U.S. PATENT DOCUMENTS

| | | | |
|---|---|---|---|
| 2,564,431 | 8/1951 | Greenspoon | 299/107 |
| 3,116,882 | 1/1964 | Vork | 239/587 |
| 3,202,360 | 8/1965 | O'Brien | 239/119 |
| 3,460,757 | 8/1969 | Adams | 239/119 |
| 3,593,920 | 7/1971 | Watson | 239/119 |
| 3,645,450 | 2/1972 | Calder | 239/116 |
| 3,667,681 | 6/1972 | Blancha | 239/393 |
| 3,695,788 | 10/1972 | Loomans | 417/488 |
| 3,752,400 | 8/1973 | Calder | 239/116 |
| 3,796,446 | 3/1974 | Shire et al. | 285/110 |
| 3,831,862 | 8/1974 | Calder | 239/526 |
| 3,955,763 | 5/1976 | Pyle et al. | 239/119 |
| 4,074,857 | 2/1978 | Calder | 239/119 |
| 4,108,379 | 8/1978 | Talley | 239/119 |
| 4,116,386 | 9/1978 | Calder | 239/119 |
| 4,157,163 | 6/1979 | Pinto et al. | 239/119 |
| 4,165,836 | 8/1979 | Eull | 239/119 |
| 4,437,610 | 3/1984 | Huber et al. | 239/119 |
| 4,465,236 | 8/1984 | Calder | 239/391 |
| 4,483,481 | 11/1984 | Calder | 239/119 |
| 4,484,707 | 11/1984 | Calder | 239/119 |
| 4,508,268 | 4/1985 | Gererth, Jr. | 239/119 |
| 4,513,913 | 4/1985 | Smith | 239/119 |
| 4,516,724 | 5/1985 | Hellman | 239/119 |
| 4,537,355 | 8/1985 | Calder | 239/119 |
| 4,611,758 | 9/1986 | Geberth, Jr. | 239/119 |
| 4,629,121 | 12/1986 | Hengesbach | 239/119 |
| 4,635,850 | 1/1987 | Leisi | 239/119 |
| 4,682,731 | 7/1987 | Bolton | 239/119 |
| 4,715,537 | 12/1987 | Calder | 239/119 |
| 4,736,892 | 4/1988 | Calder | 239/592 |
| 4,757,947 | 7/1988 | Calder | 239/119 |
| 4,819,872 | 4/1989 | Rosenberg | 239/119 |
| 4,830,281 | 5/1989 | Calder | 239/119 |
| 4,971,249 | 11/1990 | Tam et al. | 239/119 |
| 5,094,402 | 3/1992 | Perret, Jr. et al. | 239/526 |
| 5,255,848 | 10/1993 | Rhodehouse | 239/119 |
| 5,280,853 | 1/1994 | Perret, Jr. | 239/119 |
| 5,294,053 | 3/1994 | Perret, Jr. | 239/119 |
| 5,340,029 | 8/1994 | Adams | 239/119 |
| 5,365,628 | 11/1994 | Evensen | 15/23 |
| 5,379,938 | 1/1995 | Perret, Jr. | 239/119 |
| 5,379,939 | 1/1995 | Perret, Jr. | 239/119 |
| 5,454,515 | 10/1995 | Perret | 239/119 |
| 5,505,381 | 4/1996 | Torntore | 239/119 |

FOREIGN PATENT DOCUMENTS

WO 82/02501 8/1982 WIPO .

*Primary Examiner*—Andres Kashnikow
*Assistant Examiner*—Robin O. Evans
*Attorney, Agent, or Firm*—Faegre & Benson LLP

[57] ABSTRACT

A dual mode reversible spray tip seal includes a tip-retaining set screw and a resilient washer in a transverse passageway in a turret of a portable paint spray gun. A cone-shaped taper on the set screw simultaneously urges the washer both axially and radially to axially seal the upstream end of the tip and radially seal the passageway of the turret.

14 Claims, 3 Drawing Sheets

DUAL MODE REVERSIBLE SPRAY TIP

BACKGROUND OF THE INVENTION

This invention relates to the field of portable paint spraying equipment, more particularly to a seal for a high pressure, airless spray tip in a reversible turret.

DETAILED DESCRIPTION OF THE INVENTION

Figure 1:
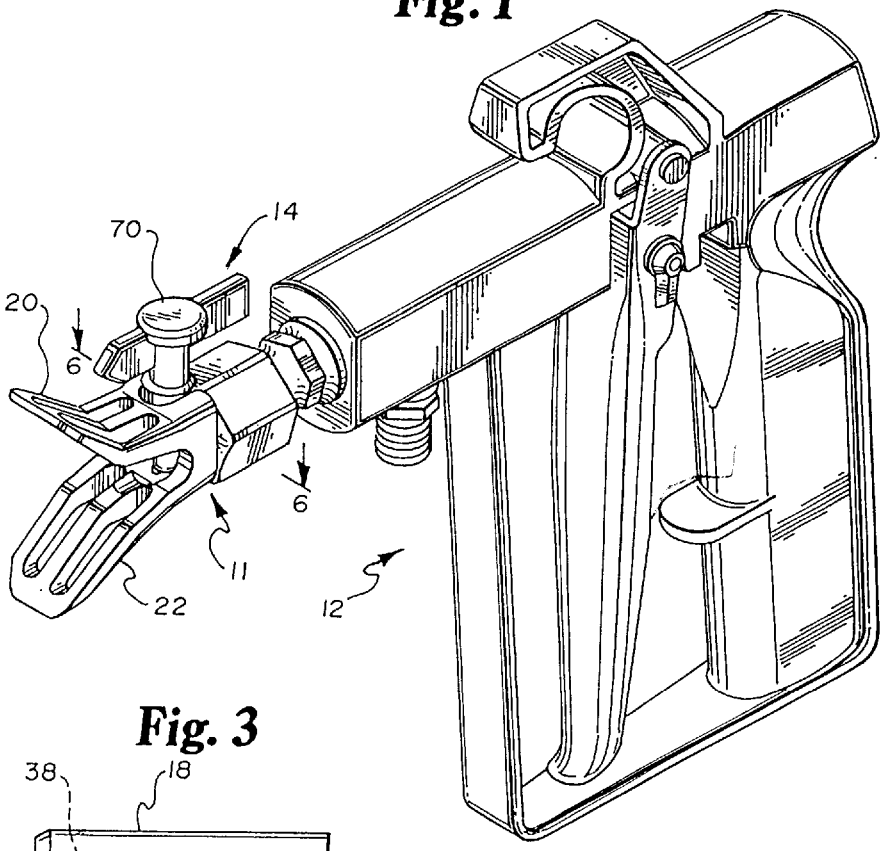
FIG. 1 is a perspective view of a spray gun carrying the reversible tip assembly of the present invention.

Referring to the Figures and most particularly to FIG. 1, a replaceable tip assembly 11 useful in the practice of the present invention may be seen. Replaceable tip assembly 11 is shown attached to an airless spray gun 12 useful for spraying paints and other similar coating materials under relatively high pressure. In such spraying applications, it has been found useful to provide a reversible mounting for the spray orifice to clear blockages. In the past, such mountings were provided by a turret assembly which had a tip with a desired orifice permanently installed in the turret. Once the orifice was worn to an unacceptable extent, the entire turret was required to be replaced, even though only the tip was worn. Because of this, it has been found desirable to permit replacement of the tip (and usually a tip seal) without replacing the remainder of the turret assembly.

Figure 2:
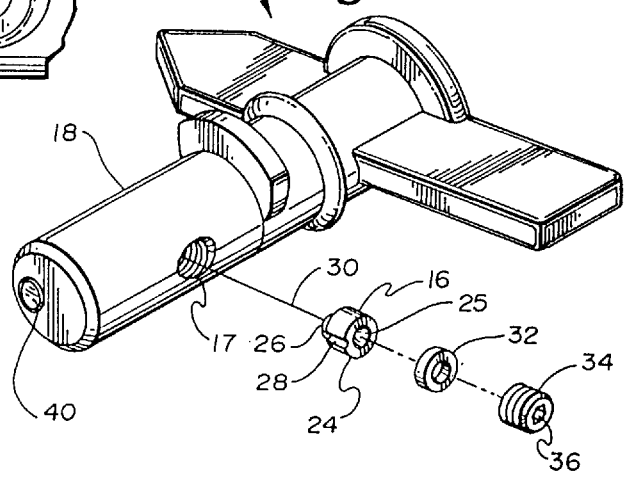
FIG. 2 is a view of a turret and user-replaceable parts exploded useful in the practice of the present invention.

FIG. 2 illustrates a turret assembly 14 which has a spray tip 16 which may be replaced by an operator. Spray tip 16 is received in a threaded bore 17 of a barrel 18 of the turret assembly 14. Spray tip 16 is preferably formed of carbide and has a "cat's eye" orifice therein requiring proper orientation to the barrel 18 to align the orifice with the spray guard wings 20 and 22. Tip 16 preferably has a generally cylindrical base 24 and a hemispherical or domed top portion 26. Base 24 also has a groove or indentation 28 aligned with the cylindrical axis 30 of the base portion 24. A resilient washer-like seal 32 (preferably formed of a type Delrin II 500 plastic, available from DuPont) is located behind the base portion 24 of tip 16. A hollow set screw 34 is threaded into bore 17 to retain tip 16, and seal 32 in barrel 18. It is to be understood that set screw 34 preferably has a hexagonal bore 36 therethrough to receive an Allen wrench (not shown) for installation and removal of the set screw 34 from barrel 18.

Figure 3:
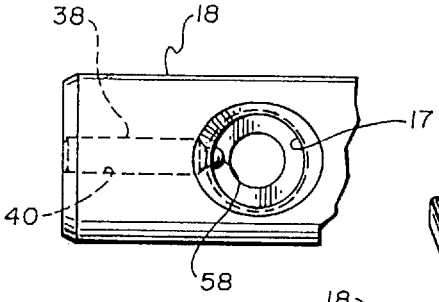
FIG. 3 is a detail view of a portion of the turret of FIG. 2.

Referring now also to FIG. 3, barrel 18 preferably has a locator pin 38 received therein in a bore 40 aligned parallel to a cylindrical axis 42 of barrel 18. Pin 38 preferably has an interference fit with bore 40 and is pressed into bore 40, resulting in a permanent installation.

Figure 4:
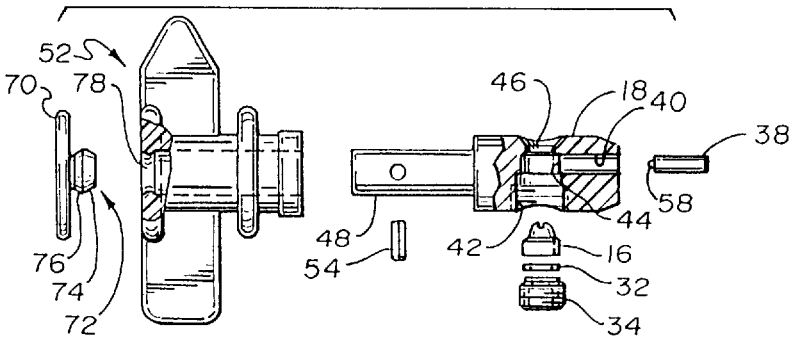
FIG. 4 is a fully exploded view of the turret and associated parts useful in the practice of the present invention.

Referring now also to FIG. 4, the bore 17 of barrel 18 is threaded in region 42, and preferably has a smooth-walled section 44 ending in a shoulder 46. Barrel 18 also preferably has a reduced diameter stem 48 having a transverse bore 50 therethrough to mount handle 52 using a roll pin 54. Barrel 18 and set screw 34 are preferably formed of stainless steel and pin 38 is preferably formed of stainless steel. Handle 52 is preferably formed of Delrin plastic.

Figure 5:
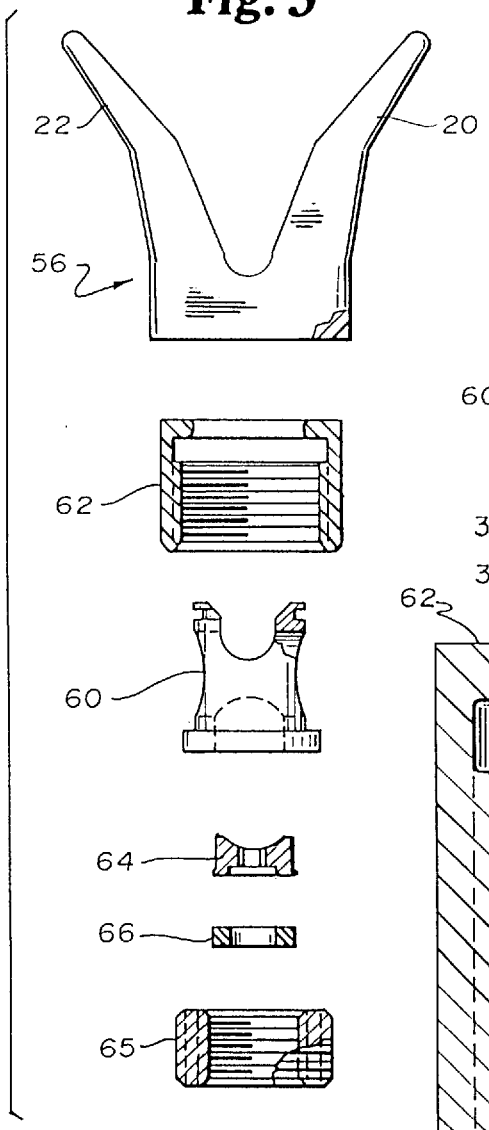
FIG. 5 is an exploded view of the reversible tip holder assembly useful in the practice of the present invention.
Figure 6:
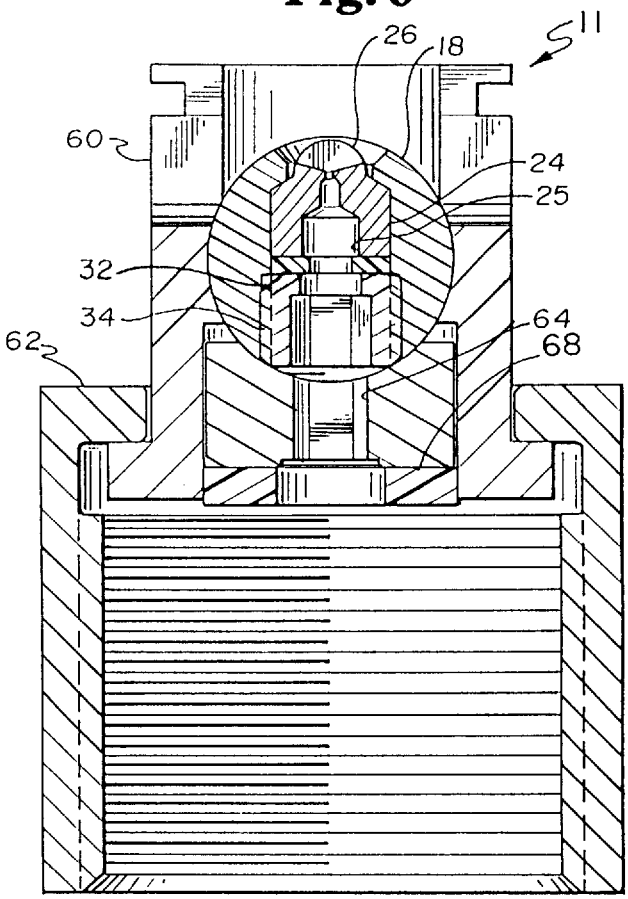
FIG. 6 is an assembly view in section of the reversible tip (without the tip guard) taken along line 6—6 of FIG. 1.
Figure 7:
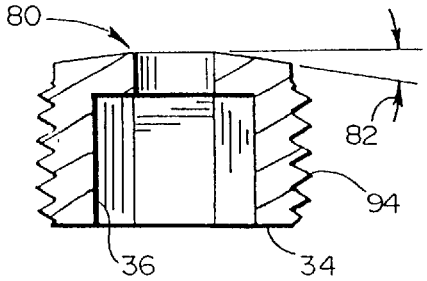
FIG. 7 is an enlarged view of a set screw useful in the practice of the present invention.
Figure 8:
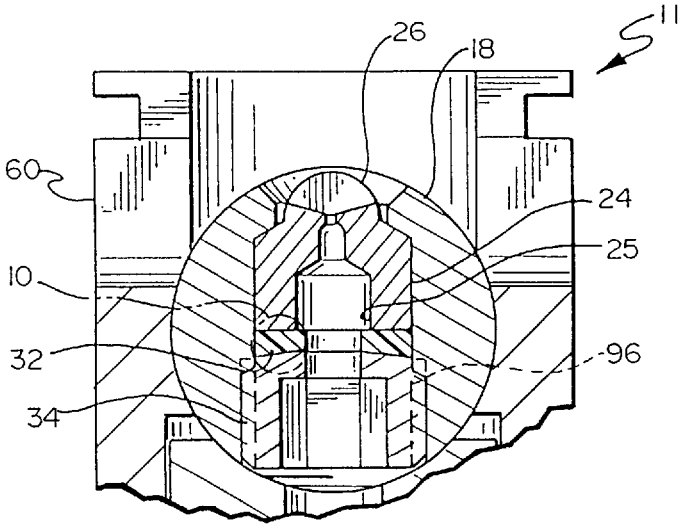
FIG. 8 is an enlarged view of the tip seal assembly of the present invention.
Figure 9:
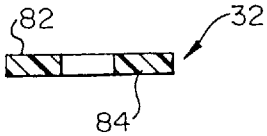
FIG. 9 is a section view of a tip seal useful in the practice of the present invention shown in a relaxed state.
Figure 10:
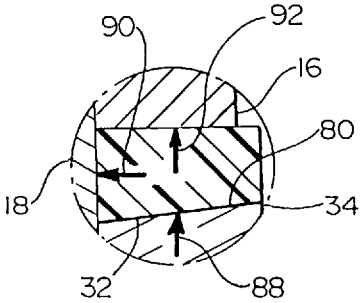
FIG. 10 is an enlarged partial section view of a portion of FIG. 8 showing operation of the tip seal.

Referring now also to FIGS. 5–7, the reversible tip assembly 11 also includes a molded guard 56 formed of polypropylene or nylon or other suitable material and has perforated ears or wings 20, 22 (see also FIG. 1). Assembly 11 also includes a seal retainer 60 preferably formed of stainless steel, and an aluminum nut 62, which may have a fluted, knurled or hexagonal exterior to secure the reversible tip assembly 11 to the gun 12. Assembly 11 also has a turret saddle seal 64 preferably of stainless steel, and either a rubber washer-like seal 66 (see FIG. 6) or a lip-type Delrin plastic seal 68 (see FIG. 6). It is to be understood that rubber is preferred especially for latex paint spraying applications where water is used for cleanup, and the Delrin plastic seal is preferred for oil-based paint applications, where relatively active solvents such as MEK or lacquer thinner may be used and which would attack a rubber seal. Whether rubber or synthetic plastic material is used for the saddle seal, it has been found preferable to make the seal thickness sufficient to cause the saddle 64 to seal against the turret barrel 18 when compressed. Most desirably, the nut 62 is tightened until the saddle seal 64 is in metal-to-metal contact with the front surface of the gun 12, causing a predetermined amount of compression of seal 66 or 68 such that turret assembly 14 may be rotated between spraying and cleaning positions without loosening nut 62, while at the same time providing sufficient sealing to prevent leakage between turret barrel 18 and saddle seal 64.

Referring now to FIGS. 7, 8, 9, and 10 the present invention includes a modified set screw 34 having at least a portion of its downstream end tapered in a cone-like profile 80. The angle 82 of profile 80 is preferably 5 degrees. Tip seal 32 is preferably shaped like a washer with flat, parallel sides with seal in a relaxed state. As may be seen most clearly in FIGS. 8 and 10, when set screw 34 is tightened against seal 32 (indicated by arrow 88 in FIG. 10), seal 32 is urged against tip 16, and seal 32 will deform to a trapezoidal cross section. In particular, it has been found that forming the cone-shaped profile 80 on the downstream end of the set screw 34 results in the seal 32 acting both axially against the tip 16 (as indicated by arrow 90 in FIG. 10) and radially against the transverse bore 17 of the turret barrel 18 (as indicated by arrow 92 in FIG. 10). This dual action of radial and axial sealing by seal 32 caused by the cone shaped profile 80 of set screw 34 provides the benefit of two seals, blocking radial leakage of paint between seal 32 and tip 16 while simultaneously blocking axial flow of paint between seal 32 and turret barrel 18. Thus two potential leak paths are blocked by the dual mode seal assembly of the present invention without adding substantial cost or complexity.

Referring now most particularly to FIGS. 2 and 3, tip 16 is installed by aligning indentation 28 on tip 16 with a dome 58 formed on the end of pin 38 and which projects into bore 17. Tip 16 is then moved toward turret barrel 18 along axis 30 until tip 16 engages shoulder 46 in barrel 18. Seal 32 is then inserted behind the base 24 of tip 16 in bore 17. Finally set screw 34 is threaded into the matingly threaded portion 42 of bore 17 in barrel 18 until secure, using a hexagonal Allen wrench received in the hexagonally shaped bore 36 in set screw 34. It is to be understood that once the above installation procedure is completed, set screw 34 will be completely within the cylindrical outer surface of barrel 18, permitting rotation barrel 18 when the barrel 18 is installed in the seal retainer 60 and resides against saddle 64. Tip 16 is removed from turret assembly 14 by unthreading set screw 34 using an Allen wrench, and withdrawing seal 32 and tip 16 axially away from barrel 18 along axis 30. When a new tip 16 is installed in barrel 18, a new seal 32 is preferably installed and the old seal is discarded. Also, a corresponding plug 70 is also preferably installed to identify the orifice characteristics of the tip 16 then installed in turret assembly 14.

In initial assembly at the factory, it has been found preferable to tighten the set screw 34 to 15 inch pounds of torque. For replacement in the field where a torque wrench is typically not available, it has been found satisfactory to tighten the set screw ¼ turn past the condition where the set screw 34, seal 32, and tip 16 are all in contact with each other.

The invention is not to be taken as limited to all of the details thereof as modifications and variations thereof may be made without departing from the spirit or scope of the invention. For example, it is within the spirit and scope of the present invention to provide an axial stop or shoulder between set screw 34 and barrel 18, if desired, to limit the amount seal 32 can be compressed and thus avoid over-tightening. Such an axial stop, may, for example, be provided by the range of travel of interengaging threads 94, 96 on the set screw 24 and threaded bore 17 of barrel 18.

What is claimed is:

1. A reversible tip assembly comprising;

a) a rotatable, generally cylindrical turret having a transverse bore therethrough and a handle at one longitudinal end thereof;

b) a replaceable tip element having a spray orifice therein located in the transverse bore of the turret;

c) a resilient washer-like seal located upstream of the replaceable tip element; and d) a hollow set screw located upstream of the seal and threaded into the transverse bore of the turret wherein the hollow set screw has a coneshaped profile on a downstream surface thereof in contact with the resilient seal such that the cone-shaped profile urges the seal both axially against the tip and radially outward against the transverse bore of the turret to prevent leakage past the tip.

2. The assembly of claim 1 wherein the cone-shaped profile is tapered at an acute angle.

3. The assembly of claim 2 wherein the acute angle is about 5 degrees.

4. The assembly of claim 1 further including a turret holder having a transverse bore sized to receive the turret.

5. The assembly of claim 4 wherein the turret holder further comprises a tip guard having a pair of spray guard wings extending in front of the turret holder.

6. The assembly of claim 4 further including a spray gun connected to the turret holder.

7. The assembly of claim 1 further comprising e) an axial s top between the transverse bore in the turret barrel and the set screw to limit the axial. travel of the set screw into the bore of the turret barrel.

8. The assembly of claim 7 wherein the axial stop comprises a predetermined limit of the range of travel of a set of threads on the set screw and a set of threads in the transverse bore of the turret barrel.

9. A method of sealing a replaceable tip in a reversible turret comprising the steps of:

a) inserting a replaceable tip in a transverse bore of a reversible turret;

b) inserting a washer-like seal behind the tip in the transverse bore of the turret;

c) threading a hollow set screw into a set of mating threads in the transverse bore of the turret wherein the set screw has a cone-shaped profile adjacent the seal such that the seal is urged axially against the tip and radially against the bore of the turret by the cone-shaped profile of the set screw.

10. The method of claim 9 wherein step c) further comprises monitoring a torque while threading the set screw into the transverse bore and stopping when a predetermined torque setting is reached.

11. The method of claim 10 wherein the predetermined torque setting is about 15 inch pounds.

12. The method of claim 9 wherein step c) further comprises turning the set screw a predetermined amount of rotation past a condition where the set screw, tip and seal are all in contact.

13. The method of claim 12 wherein the predetermined amount of rotation is about one quarter turn.

14. A reversible tip and spray gun assembly comprising;

a) a portable, airless paint spray gun;

b) a turret holder mounted to the spray gun;

c) a rotatable, generally cylindrical turret received in the turret holder and having a transverse bore therethrough and a handle at one longitudinal end thereof;

d) a replaceable tip element having a spray orifice therein located in the transverse bore of the turret;

e) a resilient washer-like seal located upstream of the replaceable tip element; and f) a hollow set screw located upstream of the seal and threaded into the transverse bore of the turret wherein the hollow set screw has a coneshaped profile on a downstream surface thereof in contact with the resilient seal such that the cone-shaped profile urges the seal both axially against the tip and radially outward against the transverse bore of the turret to prevent leakage past the tip when paint is directed through the turret holder to be atomized by the tip in the turret.

* * * * *

UNITED STATES PATENT AND TRADEMARK OFFICE

CERTIFICATE OF CORRECTION

PATENT NO. : 5,887,793
DATED : March 30, 1999
INVENTOR(S) : Kieffer

It is certified that error appears in the above-indentified patent and that said Letters Patent is hereby corrected as shown below:

Column 2, line 23, delete "6" and insert therefor -- 5 --.

Column 4, line 7, delete "s top" and insert therefore – stop --.

Column 4, line 8, delete "." after axial.

Signed and Sealed this

Twenty-eighth Day of September, 1999

*Attest:*

Q. TODD DICKINSON

*Attesting Officer*

*Acting Commissioner of Patents and Trademarks*